US011700924B2

(12) United States Patent
Deng

(10) Patent No.: US 11,700,924 B2
(45) Date of Patent: Jul. 18, 2023

(54) INTEGRATED SELF-OPENING AND SELF-CLOSING STAIRS-CLIMBING TROLLEY CASE

(71) Applicant: Yinglai Deng, Liuyang (CN)

(72) Inventor: Yinglai Deng, Liuyang (CN)

( * ) Notice: Subject to any disclaimer, the term of this patent is extended or adjusted under 35 U.S.C. 154(b) by 0 days.

(21) Appl. No.: 17/701,688

(22) Filed: Mar. 23, 2022

(65) Prior Publication Data

US 2022/0304434 A1 Sep. 29, 2022

(30) Foreign Application Priority Data

Mar. 26, 2021 (CN) ..... 202110327208.4

(51) Int. Cl.

| | |
|---|---|
| ***A45C 5/14*** | (2006.01) |
| ***A45C 5/03*** | (2006.01) |
| ***A45C 13/26*** | (2006.01) |
| ***A45C 15/00*** | (2006.01) |

(52) U.S. Cl.

CPC ..... *A45C 5/14* (2013.01); *A45C 5/03* (2013.01); *A45C 13/262* (2013.01); *A45C 15/00* (2013.01); *A45C 2005/147* (2013.01); *A45C 2013/267* (2013.01)

(58) Field of Classification Search

CPC ... A45C 5/14; A45C 13/262; A45C 2005/147; A45C 2013/267

See application file for complete search history.

(56) References Cited

U.S. PATENT DOCUMENTS 4,027,889 A * 6/1977 Krofchalk ..... B62B 5/02 180/9.22
4,130,291 A * 12/1978 Saethre ..... B62B 5/025 280/5.22
2004/0094378 A1* 5/2004 Gandy ..... A45C 5/14 190/18 R

FOREIGN PATENT DOCUMENTS

| | | | |
|---|---|---|---|
| CN | 203244041 U | * | 10/2013 |
| CN | 103976537 A | * | 8/2014 |
| CN | 205728526 U | * | 11/2016 |
| CN | 106963081 A | * | 7/2017 |
| CN | 207186205 U | * | 4/2018 |
| JP | H08112126 A | * | 10/1994 |
| KR | 0136181 Y1 | * | 3/1999 |
| KR | 20120131610 A | * | 12/2012 |

* cited by examiner

*Primary Examiner* — Jennifer Robertson
*Assistant Examiner* — Justin Caudill
(74) *Attorney, Agent, or Firm* — Bayramoglu Law Offices LLC

(57) ABSTRACT

An integrated self-opening and self-closing stairs-climbing trolley case is provided. The integrated self-opening and self-closing stairs-climbing trolley case includes a case body, wherein a bottom of the case body is provided with universal wheels, a telescopic draw bar is arranged on a side of the case body, a bottom of a sliding plate is provided with unidirectional wheels, an inner bracket is respectively connected with the telescopic draw bar and the case body, limiting connecting rods on left and right sides are movably connected with the inner bracket via a first connecting rod and are movably connected with the sliding plate via a second connecting rod, torsional spring connecting rods on the left and right sides are movably connected with the inner bracket via a third connecting rod and are movably connected with the sliding plate via a fourth connecting rod.

18 Claims, 6 Drawing Sheets

INTEGRATED SELF-OPENING AND SELF-CLOSING STAIRS-CLIMBING TROLLEY CASE

CROSS REFERENCE TO THE RELATED APPLICATIONS

This application is based upon and claims priority to Chinese Patent Application No. 202110327208.4, filed on Mar. 26, 2021, the entire contents of which are incorporated herein by reference.

TECHNICAL FIELD

The present invention relates to the field of cases and bags, in particular to an integrated self-opening and self-closing stairs-climbing trolley case.

BACKGROUND

Luggage cases are indispensable tools for people to go out to travel. Most traditional trolley cases can only be dragged on flat roads and can only be lifted by hands or carried on shoulders when people walk up and down the stairs, which is laborsome and time-consuming. Especially when the trolley case is particularly heavy, it is more laborsome to carry the trolley case, and people stumble and even cannot carry the trolley case.

Presently, most luggage cases facilitating walking up and down the stairs in the market are six-rotating wheel or single large rotating wheel luggage cases, are poor in universality for stairs with different gradients, and are pulled with a lot of strength if the steps are higher, so that it is quite laborsome. Moreover, bounces are large and noises are loud in the stairs-climbing process as the luggage cases are not provided with shock-absorbing devices and cushioning devices, so that it is likely to cause large damages to the luggage cases themselves or fragile products in the luggage cases. In particular, as the six rotating wheels and the large rotating wheel are directional wheels, the luggage cases cannot be pushed forward but pulled forward in a laborsome manner, and the luggage cases have large volumes, which affects the appearance, and it is inconvenient to place the luggage cases.

SUMMARY

The present invention is intended to provide an integrated self-opening and self-closing stairs-climbing trolley case.

In order to achieve the objective, the present invention adopts a technical scheme as follows:

An integrated self-opening and self-closing stairs-climbing trolley case includes a case body, universal wheels, a telescopic draw bar, a sliding plate, unidirectional wheels, an elastic device, a shock-absorbing device, limiting connecting rods, torsional spring connecting rods, an inner bracket, a first connecting rod, a second connecting rod, a third connecting rod and a fourth connecting rod, where a bottom of the case body is provided with the universal wheels, a bottom of the sliding plate is provided with the unidirectional wheels, the telescopic draw bar is arranged on one side of the case body, the inner bracket is respectively connected with the telescopic draw bar and the case body, the limiting connecting rods on left and right sides are movably connected with the inner bracket via the first connecting rod and are movably connected with the sliding plate via the second connecting rod, the torsional spring connecting rods on left and right sides are movably connected with the inner bracket via the third connecting rod and are movably connected with the sliding plate via the fourth connecting rod, the limiting connecting rods, the inner bracket, the torsional spring connecting rods and the sliding plate form a double rocker bar mechanism, one end of the elastic device is connected with the inner bracket and the other end of the elastic device is connected with the fourth connecting rod, the shock-absorbing device is arranged between the sliding plate and the inner bracket, and the sliding plate drives the unidirectional wheels to displace upwards via elastic forces of the elastic device and the shock-absorbing device till the tops of the limiting connecting rods abut against the inner bracket, so that the sliding plate is in a normally closed state with respect to the case body, and at the moment, a bottom horizontal line of each of the unidirectional wheels is higher than a bottom horizontal line of each of the universal wheels; and when the sliding plate is subjected to an external force, the sliding plate drives the unidirectional wheels to displace downwards till the bottoms of the torsional spring connecting rods abut against the inner bracket, so that the sliding plate is in an open state with respect to the case body, and at the moment, the bottom horizontal line of each of the unidirectional wheels is lower than the bottom horizontal line of each of the universal wheels.

Preferably, the elastic device is a tension spring or a rubber band.

Preferably, the shock-absorbing device is a torsional spring, and the torsional spring is sleeved at two ends of the third connecting rod.

Preferably, a cross section of the sliding plate is in a U shape, the case body is provided with notches matched with two sides of the sliding plate, two sides of the sliding plate are clamped on the notches, the sliding plate and the case body form an accommodating cavity, and the elastic device, the shock-absorbing device, the limiting connecting rods, the torsional spring connecting rods, the inner bracket, the first connecting rod, the second connecting rod, the third connecting rod and the fourth connecting rod are arranged in the accommodating cavity.

Preferably, the integrated self-opening and self-closing stairs-climbing trolley case further includes a cross-shoulder strap, where one end of the cross-shoulder strap, passes through a tri-glide button to form a large closed circular ring for a cross-back of a shoulder, and the other end of the cross-shoulder strap is connected with the top of the telescopic draw bar.

Preferably, the case body or the telescopic draw bar is provided with a cavity, and the cavity is internally provided with a mobile power bank.

Preferably, the sliding plate is of a corrugated structure.

Preferably, left and right sides of the sliding plate are both provided with arched convex blocks.

Preferably, each of the arched convex blocks is provided with either a detachable wear strip or a sliding chute, and the sliding chute is internally provided with a sliding strip.

Preferably, the top of the sliding plate and the bottom of the inner bracket are both provided with a buffer sponge or a spring.

The present invention has the beneficial advantages:

1) The trolley case provided by the present invention can be pushed and pulled on a smooth pavement via four universal wheels at the bottom of the case body, so that it is quite labor-saving. In complicated road conditions such as gravels, unsurfaced roads and mountain roads, the trolley case is dragged forward with the unidirectional wheels. The unidirectional wheels have large bearings and are relatively stable in direction, and do not bounce back and forth on a bumpy ground with respect to the universal wheels which bounce back and forth. The trolley case can pass through steps or stairs quickly by directly matching the sliding plate with the unidirectional wheels under the sliding plate. The trolley case provided by the present invention is easy to operate and convenient to use, suitable for various complicated road conditions and convenient for people to go out.

2) When the trolley case provided by the present invention walks up or down the stairs, the tension spring, the torsional spring and the buffer sponge play shock-absorbing and cushioning function, so that it neither causes large damages to the trolley case itself or the fragile products in the trolley case nor generate loud noises and large vibration.

3) The trolley case provided by the present invention climbs the stairs by using the sliding plate. As the sliding plate is larger in span, the cut-in angle can be changed by lifting or lowering the telescopic draw bar, namely, it can be used on steps with various gradients.

4) The devices such as the sliding plate in the present invention can be hidden in a lower portion of a back of the case body, and when the sliding plate is in a normally closed state, the sliding plate and the case body are integrated, and it is difficult to tell the difference between the trolley case and a common trolley case from the appearance. Therefore, the trolley case is more beautiful.

5) In the present invention, the cross-shoulder strap matched with the telescopic draw bar in use is arranged. When the luggage is overweight, the cross-shoulder strap is tied to a handle of the draw bar and the trolley case is carried on the shoulder like a bag, with the shoulder assisting in dragging the trolley case to walk up and down the stairs. The trolley case can be carried on the shoulder and is dragged to glide on a flat road. The unique design not only is labor-saving, but also liberates both hands, thereby facilitating going out greatly.

BRIEF DESCRIPTION OF THE DRAWINGS

Further description of specific embodiments of the present invention in detail will be made below in combination with drawings.

In the drawings, numerals of drawings.

Figure 1:
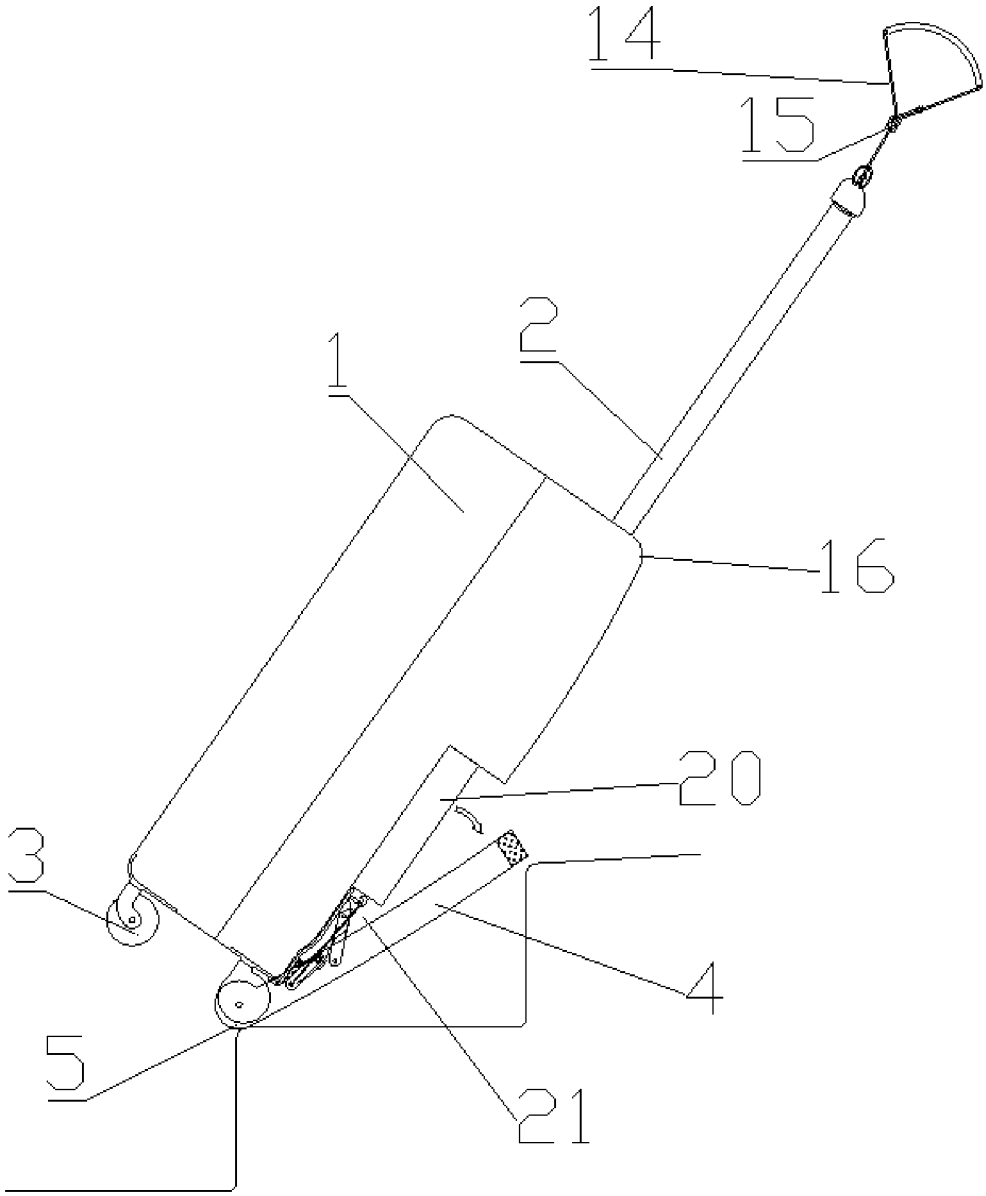
FIG. 1 is an integral schematic diagram of an integrated self-opening and self-closing stairs-climbing trolley case of the present invention.
Figure 2:
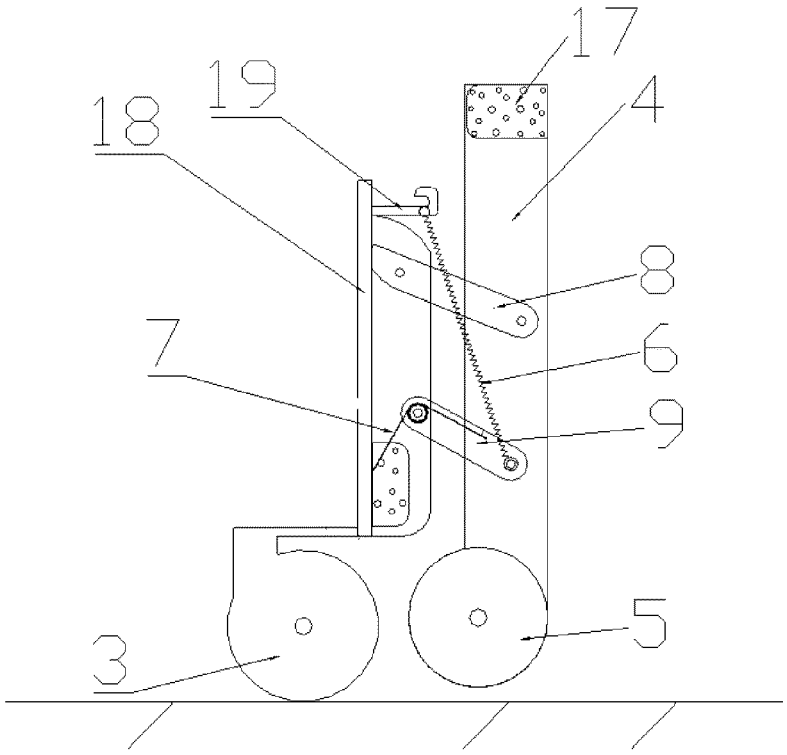
FIG. 2 is a partial side view of an integrated self-opening and self-closing stairs-climbing trolley case of the present invention.
Figure 3:
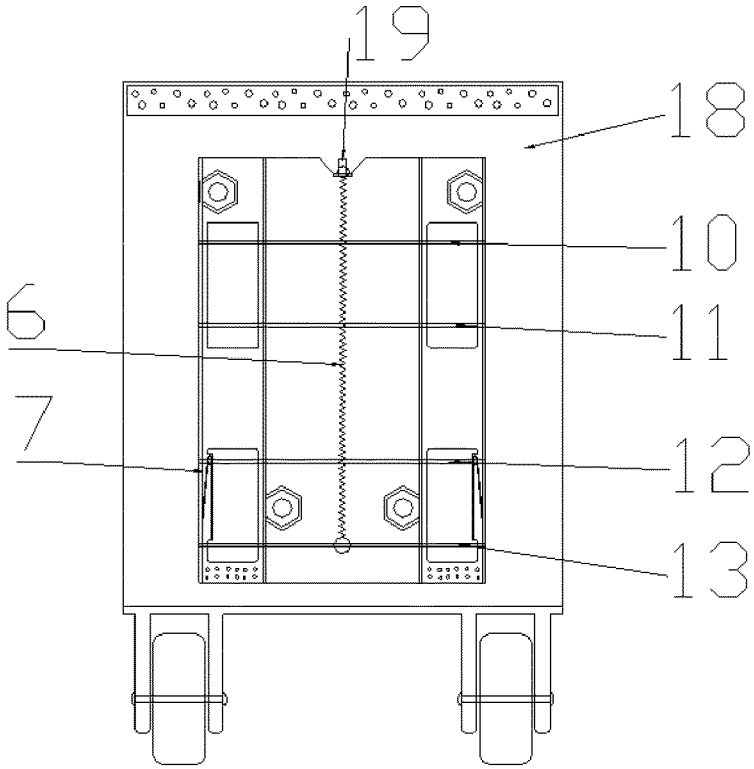
FIG. 3 is a partial rear view of an integrated self-opening and self-closing stairs-climbing trolley case of the present invention.
Figure 4:
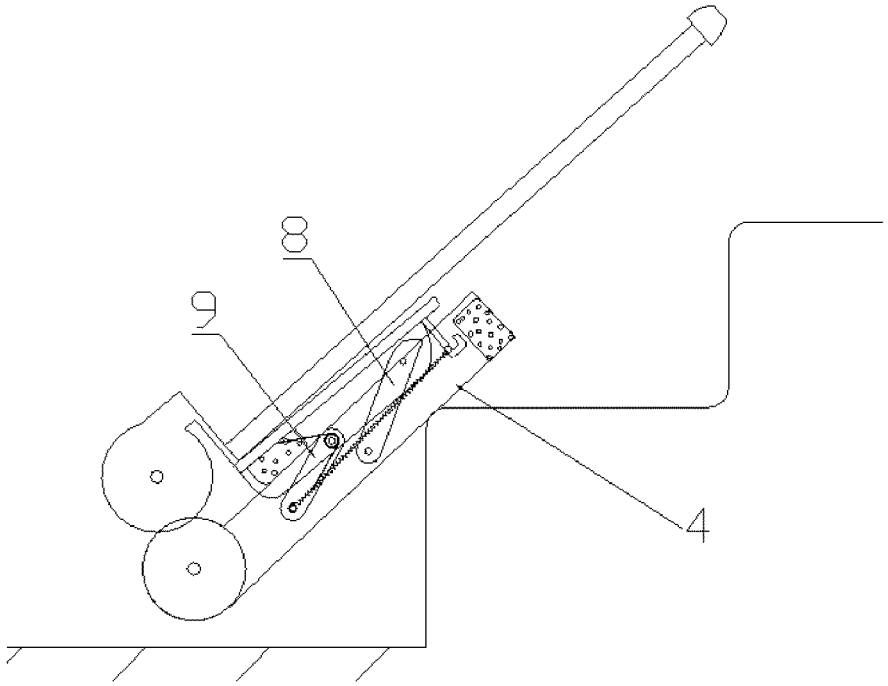
FIG. 4 is a state diagram of a sliding plate having entered a notch inwards and downwards compared with a case body when an integrated self-opening and self-closing stairs-climbing trolley case of the present invention climbs a stair
Figure 5:
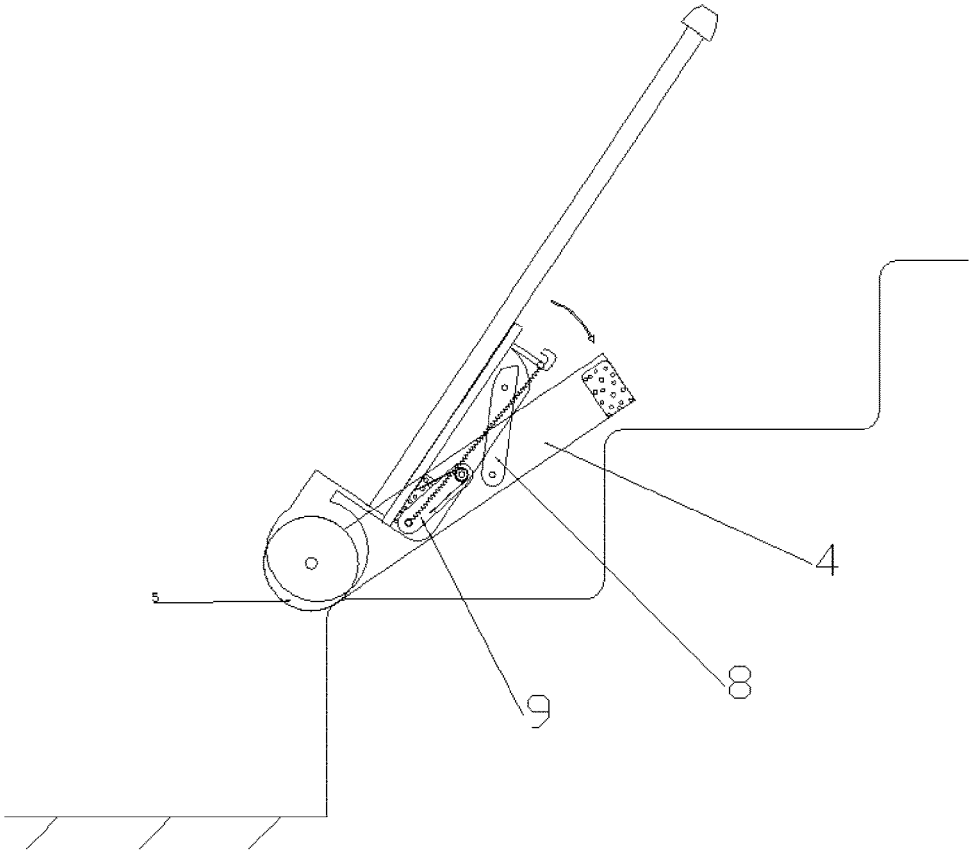
FIG. 5 is a state diagram of a sliding plate is opened compared with a case body when an integrated self-opening and self-closing stairs-climbing trolley case of the present invention climbs a stair.

1—case body; 2—telescopic draw bar; 3—universal wheel; 4—sliding plate; 401—arched convex block; 402—detachable wear strip; 403—sliding chute; 404—sliding strip; 5—unidirectional wheel; 6—elastic device; 7—shock—absorbing device; 8—limiting connecting rod; 9—torsional spring connecting rod; 10—first connecting rod; 11—second connecting rod; 12—third connecting rod; 13—fourth connecting rod; 14—cross-shoulder strap; 15—tri-glide button; 16—cavity; 17—buffer sponge; 18—inner bracket; 19—hook; 20—notch; 21—accommodating cavity.

DETAILED DESCRIPTION OF THE EMBODIMENTS

In order to describe the present invention clearer, further description of the present invention will be made below in combination with preferred embodiments. Those skilled in the art shall understand that the specifically described content below is illustrative rather than restrictive, and the protection scope of the present invention shall not be limited thereby.

It is to be understood that in the description of the present invention, orientation or position relations indicated by terms "center", "upper", "lower". "front", "back", "left", "right", "vertical", "horizontal", "top", "bottom", "inner" and "outer" are orientation or position relations based on the drawings and are only used for convenient description of the present invention and simplification of the description rather than indicates or implies that the indicated devices or components must have specific orientations and are configured and operated in the specific orientations. Therefore, it cannot be construed as limitations to the present invention.

In the description of the present invention, it is to be noted that unless otherwise specified and defined, terms 'mounting', 'connecting' and 'connection' should be understood in a broad sense, for example, 'mounting', 'connecting', 'connection' and 'attaching' can be either fixed connection or detachable connection or integrated connection; can be either direct connection and can be either indirect connection via an intermediation or internal communication of two components. Those skilled in the art can understand specific meaning of the terms in the present invention under specific circumstances.

Example I

Referring to FIG. 1 to FIG. 10, an integrated self-opening and self-closing stairs-climbing trolley case of the embodiment includes a case body 1, a telescopic draw bar 2, universal wheels 3, a sliding plate 4, unidirectional wheels 5, an elastic device 6, a shock-absorbing device 7, limiting connecting rods 8, torsional spring connecting rods 9, a first connecting rod 10, a second connecting rod 11, a third connecting rod 12, a fourth connecting rod 13 and an inner bracket 18. A bottom of the case body 1 is provided with the universal wheels 3, a bottom of the sliding plate 4 is provided with the unidirectional wheels 5, and the telescopic draw bar 2 is arranged on one side of the case body 1. As the case body 1 is made by adopting a plastic sucking process, the case body cannot be thickened locally, and therefore, the inner bracket is mounted between the case body and the telescopic draw bar. One side of the inner bracket 18 is fixedly connected with a bottom bracket of the telescopic draw bar 2 via a screw or a rivet and the other side of the inner bracket is connected with the bottom of the case body 1. The limiting connecting rods 8 on left and right sides are movably connected with the inner bracket 18 via the first connecting rod 10 and are movably connected with the sliding plate 4 via the second connecting rod 11, the torsional spring connecting rods 9 on left and right sides are movably connected with the inner bracket 18 via the third connecting rod 12 and are movably connected with the sliding plate 4 via the fourth connecting rod 13, the first connecting rod 10, the second connecting rod 11, the third connecting rod 12 and the fourth connecting rod 13 all use long knurled dowels that are used as connecting parts to connect the sliding plate 4, the limiting connecting rods 8, the torsional spring connecting rods 9 and the inner bracket 18, so that the limiting connecting rods 8, the inner bracket 18, the torsional spring connecting rods 9 and the sliding plate 4 form a double rocker bar mechanism to guarantee that the limiting connecting rods 8 and the torsional spring connecting rods 9 can transfer motions and torques; the shock-absorbing device 7 can be either the torsional spring or the spring, and the torsional spring is sleeved at two ends of the third connecting rod 12; the elastic device 6 is the tension spring, a middle position of the inner bracket is provided with a hook, one end of the tension spring is connected with the hook on the inner bracket and the other end of the tension spring is connected to the middle of the fourth connecting rod 13; the sliding plate 4 drives the unidirectional wheels 5 to displace upwards via elastic forces of the tension spring and the torsional spring till the tops of the limiting connecting rods 8 abut against the inner bracket, so that the sliding plate 4 is in a normally closed state with respect to the case body 1, and at the moment, a bottom horizontal line of each of the unidirectional wheels 5 is higher than a bottom horizontal line of each of the universal wheels 3; and when the sliding plate 4 is subjected to an external force action, the sliding plate 4 drives the unidirectional wheels 5 to displace downwards till the bottoms of the torsional spring connecting rods 9 abut against the inner bracket, so that the sliding plate 4 is in an open state with respect to the case body 1, and at the moment, the bottom horizontal line of each of the unidirectional wheels 5 is lower than the bottom horizontal line of each of the universal wheels 3. In order to prevent an additional frictional force as the universal wheels are scratched in the stairs-climbing process, a base of each of the universal wheel 3 close to each of the unidirectional wheels can be in a mode that a deviation shaft is widened or the integral universal wheel moves forward, so that the wheel of each of the universal wheels is away from each of the unidirectional wheels, namely, it is only the unidirectional wheel rather than the universal wheel moves in climbing stairs, and therefore, it is smoother and more stable to glide.

In the integrated self-opening and self-closing stairs-climbing trolley case of the embodiment, a cross section of the sliding plate 4 is in a U shape; the case body 1 is provided with notches 20 matched with two sides of the sliding plate 4; when the sliding plate 4 is in a normally closed state with respect to the case body 1, two sides of the sliding plate 4 are clamped in the notches 20, and the sliding plate and the case body 1 form an accommodating cavity 21; the elastic device 6, the shock-absorbing device 7, the limiting connecting rods 8, the torsional spring connecting rods 9, the inner bracket 18, the first connecting rod 10, the second connecting rod 11, the third connecting rod 12 and the fourth connecting rod 13 are arranged in the accommodating cavity 21; and when the sliding plate is in a normally closed state, the sliding plate and the case body are integrated, and it is difficult to tell the difference between the trolley case and a common trolley case from the appearance. Therefore, the trolley case is more beautiful.

The integrated self-opening and self-closing stairs-climbing trolley case of the embodiment further includes a cross-shoulder strap 14, where one end of the cross-shoulder strap 14 passes through a protective pad made from a flexible material and a tri-glide button 15 to form a large closed circular ring for a cross-back of a shoulder and is fixed by a double-sided rivet, and the other end of the cross-shoulder strap 14 is folded and is fixed by the double-sided rivet to form a small closed circular ring. During use, according to heights of different users, the length of the cross-shoulder strap 14 is adjusted via the tri-glide button 15, the large closed circular ring of the cross-shoulder strap 14 partially winds a top handle of the telescopic draw bar 2 and passes through the small closed circular ring, so that the cross-shoulder strap 14 and the telescopic draw bar 2 are temporarily and movably connected. The trolley case is dragged by the cross-shoulder strap 14 to climb stairs up and down, and can be dragged to glide on the flat rod like a bag carried on the shoulder, thereby, saving the labor and liberating both hands. When the trolley case is not used, the cross-shoulder strap 14 can be further taken down from the telescopic draw bar 2. The cross-shoulder strap 14 is as large as a lighter after being folded, so that it is convenient to carry. But not limited herein, the other end of the cross-shoulder strap 14 can be directly bound to the top of the telescopic draw bar 2 or is movably connected with the telescopic draw bar 2 by way of a snap-fastener, a hook and the like.

In the integrated self-opening and self-closing stairs-climbing trolley case in the embodiment, a top cover of the telescopic draw bar is provided with a cavity where a mobile power bank can be inserted into, the mobile power bank being used for charging a mobile phone.

In the integrated self-opening and self-closing stairs-climbing trolley case in the embodiment, the sliding plate 4 is of a corrugated structure. The corrugated structure consists of many small arches which can decompose and transfer applied forces downwards and in left and right directions. By adopting the corrugated structure, the bending resistance and the impact resistance of the sliding plate 4 are improved. The sliding plate 4 in the embodiment has a thickness of about 2 mm, and thereby, the weight and the cost of the sliding plate are greatly reduced. The actual thickness, but not limited to, can be adjusted according to customer requirements.

In the integrated self-opening and self-closing stairs-climbing trolley case in the embodiment, left and right sides of the sliding plate 4 are both provided with arched convex blocks 401. The two arched convex blocks 401 are slightly higher than the middle small arches, so that resistance is reduced, it is smoother to glide, and the middle of the sliding plate 4 can be prevented from contacting with obstacles and the sliding plate 4 is prevented from being replaced integrally after the sliding plate 4 is scratched. The arched convex blocks 401 on the two sides of the sliding plate 4 can be provided with detachable wear strips 402, and it is unnecessary to replace the whole sliding plate 4 but to replace the detachable wear strips 402 only. The sliding plate 4 is designed as a straight-through type or an arc shape. The sliding plate 4 can be made from wear-resistant materials with low friction coefficient such as tetrafluoroethylene, upe and nylon.

In the integrated self-opening and self-closing stairs-climbing trolley case in the embodiment, the top of the sliding plate 4 is provided with a buffer sponge 17. In the stairs-climbing process, the top of the sliding plate 4 will collide with the case body 1, and the buffer sponge 17 separates the sliding plate from the case body to play cushioning and damping roles. The bottom of the inner bracket 18 is provided with a buffer sponge 17 as well to cushion an impact force of the torsional spring connecting rods 9 to the inner bracket 18, absorb kinetic energy and reduce noises.

Use Method

When the trolley case climbs the stairs, opening and closing of the sliding plate 4 are controlled automatically by means of transfer of the center of gravity and a force bearing point. When the trolley case is dragged to climb the stairs, the force bearing point of the trolley case is transferred to the front end of the sliding plate 4 instantaneously from the unidirectional wheels 5; under the impact of the gravity of the trolley case, the sliding plate 4 moves inwards and downwards to unload the force (FIG. 4), and at the moment, two side edges of the sliding plate 4 enter the notches 20, only the buffer sponge 17 at the top of the sliding plate 4 contacts with the back of the case body 1, and the buffer sponge 17 is compressed to relieve impact. After climbing a step, the force bearing point of the trolley case is transferred from the front end of the sliding plate 4 to the unidirectional wheels 5. Under the gravity of the trolley case and the forward tension, the sliding plate 4 is opened automatically, and the top end of the sliding plate 4 begins to contact with the second step (FIG. 5), and the cycle is repeated. Once climbing a step, the sliding plate 4 is opened and closed once automatically like playing a seesaw. The unique damping mode relieves the impact force of the step to the trolley case greatly. When people walks down the stairs, the trolley case is in front and people stand behind the trolley case to push it to walk down the stairs, so does the damping mode.

Figure 6:
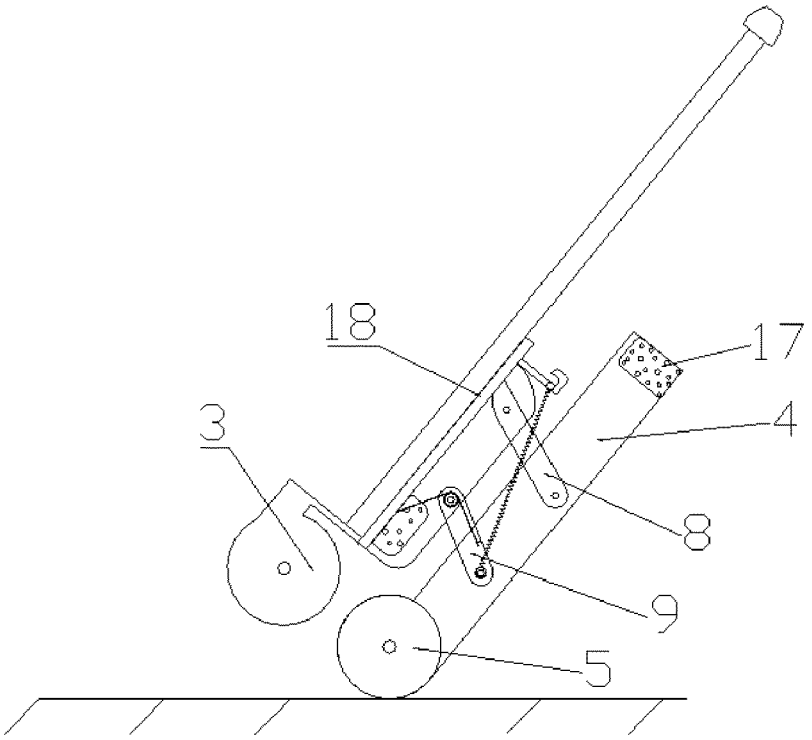
FIG. 6 is an application drawing of an integrated self-opening and self-closing stairs-climbing trolley case of the present invention running with unidirectional wheels on a flat ground.
Figure 7:
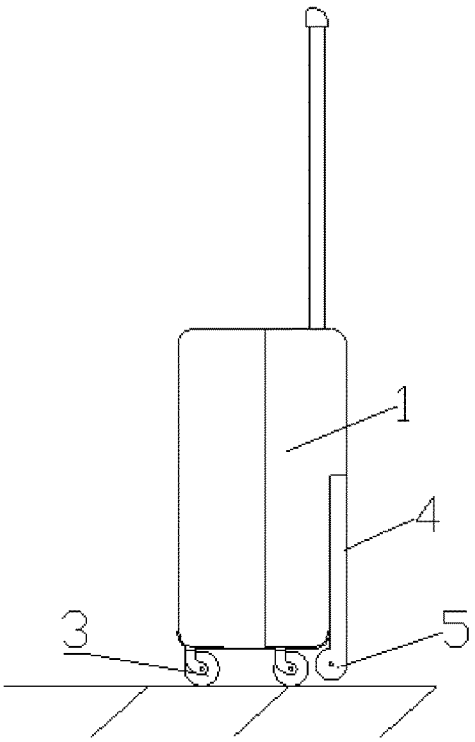
FIG. 7 is an application drawing of an integrated self-opening and self-closing stairs-climbing trolley case of the present invention running with universal wheels on a flat ground.
Figure 8:
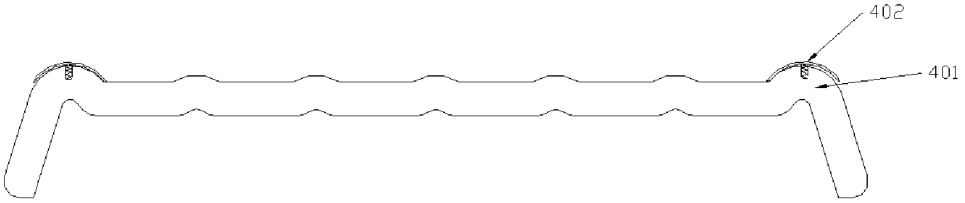
FIG. 8 is a structural schematic diagram of a sliding plate in an embodiment I of an integrated self-opening and self-closing stairs-climbing trolley case of the present invention.
Figure 9:
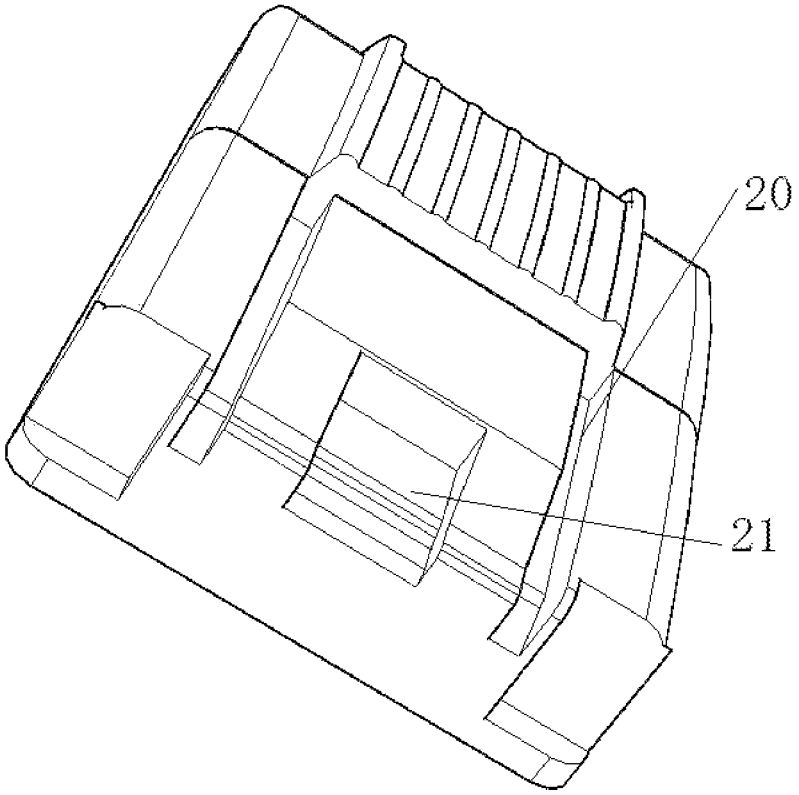
FIG. 9 is a structural schematic diagram of a back of a case body in an integrated self-opening and self-closing stairs-climbing trolley case of the present invention.
Figure 10:
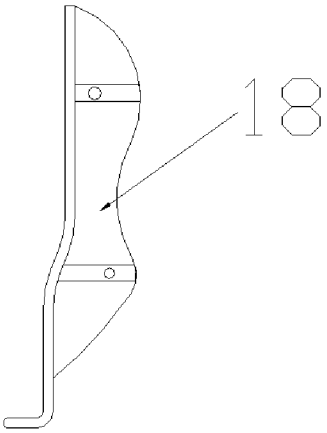
FIG. 10 is a structural schematic diagram of an inner bracket in an integrated self-opening and self-closing stairs-climbing trolley case of the present invention.

When walking on the flat road, the trolley case is erected, the force bearing point of the trolley case is transferred from the unidirectional wheels 5 to the four universal wheels 3, and under the acting forces of the tension spring and the torsional spring, the sliding plate 4 moves upwards to return to the normally closed state. At the moment, the trolley case can be either pushed forward (FIG. 7) in the horizontal direction or pulled to walk (FIG. 6). When the trolley case is pulled forward in the flat road, the sliding plate 4 is not opened because the force bearing points of the trolley case are at the bottoms of the unidirectional wheels 5 at the moment, the sliding plate 4 is subjected to an upward acting force, the tops of the two limiting connecting rods 8 abut against the top of the inner bracket 18, and the sliding plate 4 no longer moves upwards continuously, so that the sliding plate 4 is in a closed state with respect to the case body 1. Only the force bearing points are over the tops of the unidirectional wheels 5 and the sliding plate 4 is subjected to an external force, can the sliding plate 4 be opened, namely, there must be a difference of height on the ground. For example, in complicated road conditions such as steps and pot holes, the sliding plate 4 will be opened automatically to help people overcome obstacles quickly.

Example II

Figure 11:
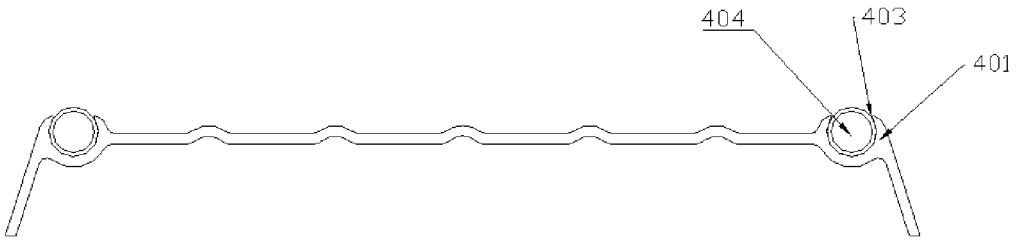
FIG. 11 is a structural schematic diagram of a sliding plate in an embodiment II of an integrated self-opening and self-closing stairs-climbing trolley case of the present invention.

As shown in FIG. 11, the difference between the embodiment and the embodiment I lies in that each of the arched convex blocks 401 is provided with a sliding chute 403 where a sliding strip 404 can be inserted into, and thus, the sliding strip 404 can be drawn out periodically and replaced, so that it is more convenient and efficient to operate.

It is apparent that the above is the embodiments of the integrated self-opening and self-closing stairs-climbing trolley case, the above embodiments of the present invention are merely to describe examples of the present invention rather than limiting implementation modes of the present invention. Those skilled in the art can make other changes or alternations in different forms on this basis. It is unable to list all the implementation methods, and apparent changes or alternations derived from the technical scheme of the present invention shall fall into the protection scope of the present invention.

What is claimed is:

1. An integrated self-opening and self-closing stairs-climbing trolley case, comprising a case body, universal wheels, a telescopic draw bar, a sliding plate, unidirectional wheels, an elastic device, a shock-absorbing device, limiting connecting rods, torsional spring connecting rods, an inner bracket, a first connecting rod, a second connecting rod, a third connecting rod and a fourth connecting rod, wherein a bottom of the case body is provided with the universal wheels, a bottom of the sliding plate is provided with the unidirectional wheels, the telescopic draw bar is arranged on a side of the case body, the inner bracket is respectively connected with the telescopic draw bar and the case body, the limiting connecting rods on left and right sides are movably connected with the inner bracket via the first connecting rod and the limiting connecting rods are movably connected with the sliding plate via the second connecting rod, the torsional spring connecting rods on the left and right sides are movably connected with the inner bracket via the third connecting rod and the torsional spring connecting rods are movably connected with the sliding plate via the fourth connecting rod, the limiting connecting rods, the inner bracket, the torsional spring connecting rods and the sliding plate form a double rocker bar mechanism, a first end of the elastic device is connected with the inner bracket and a second end of the elastic device is connected with the fourth connecting rod, the shock-absorbing device is arranged between the sliding plate and the inner bracket, the sliding plate drives the unidirectional wheels to displace upwards via elastic forces of the elastic device and the shock-absorbing device until tops of the limiting connecting rods abut against the inner bracket, wherein when the sliding plate is in a normally closed state with respect to the case body, a bottom horizontal line of each of the unidirectional wheels is higher than a bottom horizontal line of each of the universal wheels; and when the sliding plate is subjected to an external force, the sliding plate drives the unidirectional wheels to displace downwards until bottoms of the torsional spring connecting rods abut against the inner bracket, wherein when the sliding plate is in an open state with respect to the case body, the bottom horizontal line of each of the unidirectional wheels is lower than the bottom horizontal line of each of the universal wheels.

2. The integrated self-opening and self-closing stairs-climbing trolley case according to claim 1, wherein a top of the sliding plate and a bottom of the inner bracket are both provided with a buffer sponge or a spring.

3. The integrated self-opening and self-closing stairs-climbing trolley case according to claim 1, wherein the elastic device is a tension spring or a rubber band.

4. The integrated self-opening and self-closing stairs-climbing trolley case according to claim 3, wherein a top of the sliding plate and a bottom of the inner bracket are both provided with a buffer sponge or a spring.

5. The integrated self-opening and self-closing stairs-climbing trolley case according to claim 1, wherein the shock-absorbing device is a torsional spring, and the torsional spring is sleeved at two ends of the third connecting rod.

6. The integrated self-opening and self-closing stairs-climbing trolley case according to claim 5, wherein a top of the sliding plate and a bottom of the inner bracket are both provided with a buffer sponge or a spring.

7. The integrated self-opening and self-closing stairs-climbing trolley case according to claim 1, wherein a cross section of the sliding plate is in a U shape, the case body is provided with notches matched with two sides of the sliding plate, the two sides of the sliding plate are clamped on the notches, the sliding plate and the case body form an accommodating cavity, and the elastic device, the shock-absorbing device, the limiting connecting rods, the torsional spring connecting rods, the inner bracket, the first connecting rod, the second connecting rod, the third connecting rod and the fourth connecting rod are arranged in the accommodating cavity.

8. The integrated self-opening and self-closing stairs-climbing trolley case according to claim 7, wherein a top of the sliding plate and a bottom of the inner bracket are both provided with a buffer sponge or a spring.

9. The integrated self-opening and self-closing stairs-climbing trolley case according to claim 1, further comprising a cross-shoulder strap, wherein a first end of the cross-shoulder strap passes through a tri-glide button to form a closed circular ring for a cross-back of a shoulder, and a second end of the cross-shoulder strap is connected with a top of the telescopic draw bar.

10. The integrated self-opening and self-closing stairs-climbing trolley case according to claim 9, wherein a top of the sliding plate and a bottom of the inner bracket are both provided with a buffer sponge or a spring.

11. The integrated self-opening and self-closing stairs-climbing trolley case according to claim 1, wherein the case body or the telescopic draw bar is provided with a cavity, and the cavity is internally provided with a mobile power bank.

12. The integrated self-opening and self-closing stairs-climbing trolley case according to claim 11, wherein a top of the sliding plate and a bottom of the inner bracket are both provided with a buffer sponge or a spring.

13. The integrated self-opening and self-closing stairs-climbing trolley case according to claim 1, wherein the sliding plate is of a corrugated structure.

14. The integrated self-opening and self-closing stairs-climbing trolley case according to claim 13, wherein a top of the sliding plate and a bottom of the inner bracket are both provided with a buffer sponge or a spring.

15. The integrated self-opening and self-closing stairs-climbing trolley case according to claim 1, wherein left and right sides of the sliding plate are both provided with arched convex blocks.

16. The integrated self-opening and self-closing stairs-climbing trolley case according to claim 15, wherein each of the arched convex blocks is provided with either a detachable wear strip or a sliding chute, and the sliding chute is internally provided with a sliding strip.

17. The integrated self-opening and self-closing stairs-climbing trolley case according to claim 16, wherein a top of the sliding plate and a bottom of the inner bracket are both provided with a buffer sponge or a spring.

18. The integrated self-opening and self-closing stairs-climbing trolley case according to claim 15, wherein a top of the sliding plate and a bottom of the inner bracket are both provided with a buffer sponge or a spring.

* * * * *